US005223042A

United States Patent [19]

Milocco

[11] Patent Number: 5,223,042

[45] Date of Patent: Jun. 29, 1993

[54] WASHING PROCESS FOR AN AUTOMATIC DISHWASHING MACHINE

[75] Inventor: Claudio Milocco, Pordenone, Italy

[73] Assignee: Zanussi Elettrodomestici S.p.A., Pordenone, Italy

[21] Appl. No.: 811,036

[22] Filed: Dec. 20, 1991

[30] Foreign Application Priority Data

Feb. 6, 1991 [IT] Italy ..... PN91 A000008

[51] Int. Cl.[5] ..... B08B 9/04

[52] U.S. Cl. ..... 134/25.2; 134/25.3; 134/18; 134/26; 134/29

[58] Field of Search ..... 134/25.2, 25.3, 25.4, 134/18, 26, 29, 36, 95.3, 99.2, 103.3, 105, 108

[56] References Cited

U.S. PATENT DOCUMENTS 4,810,306 3/1989 Noren ..... 134/25.2

FOREIGN PATENT DOCUMENTS 1377024 12/1974 United Kingdom .

*Primary Examiner*—Theodore Morris
*Assistant Examiner*—Saeed T. Chaudhry
*Attorney, Agent, or Firm*—Wenderoth, Lind & Ponack

[57] ABSTRACT

A washing process for an automatic dishwashing machine, includes the steps of feeding a predetermined volume of water into the wash tub of the machine, adding a predetermined amount of detergent to the water to form a washing solution, heating the so formed washing solution, and subjecting the articles to be washed to the chemical and a mechanical action of the washing solution. After having reached a predetermined temperature, the washing solution is partially discharged and is replenished with a corresponding quantity of water. The detergent is added in two steps, respectively, before and after the partial discharge of the washing solution.

5 Claims, 1 Drawing Sheet

WASHING PROCESS FOR AN AUTOMATIC DISHWASHING MACHINE

BACKGROUND OF THE INVENTION

The present invention relates to an improved washing process to be carried out in an automatic dishwashing machine.

As is known, automatic dishwashing machines are provided with an electromechanical or electronic program control device arranged to control the main operative devices of the machine by carrying out different predetermined programs which can be selected by the user.

A modern dishwashing machine, for example, is capable of performing operative processes consisting of one or more successive phases which are selectively included in, or excluded from each program. More particularly, a program may effect a prewashing phase in which the articles are washed with washing solution at ambient temperature and/or a prewashing phase with heated washing solution, an actual washing phase, a rinsing phase in which the articles so washed are rinsed with water at ambient temperature and/or with heated water, a drying phase, etc.

The program which effects an actual washing phase, or so-called "wash cycle", is particularly important, particularly in light of the current trends of providing energy savings. As is known, a wash cycle is carried out by supplying a volume of water (usually at ambient temperature) into the wash tub of the machine, adding a metered amount of detergent (which is commonly a powdered detergent including a surfactant) to the water to form a washing solution, heating the so formed washing solution, and subjecting the articles to be washed, which are exposed to the washing solution, to a mechanical action. In a dishwasher, in particular, the articles to be washed are sprayed with the washing solution by means of special rotary spray arms, or the like.

During the progression of the washing operation, the detergent solubilizes the dirt (the organic fatty substances, for example) on the articles being washing and forms an emulsion thereof in the washing solution which at least in part tends to deposit on the bottom of the wash tub. After a given time period, therefore, the detergent exerts its chemical action not only on the dirt which is still to be removed from the articles, but also on the dirt which has already been removed therefrom and is suspended in the washing solution or has been deposited on the bottom of the wash tub. More particularly, part of the dirt released from the articles is deposited on the portion of the drain circuit at the bottom of the dishwasher along with a corresponding amount of detergent which is thus unused.

In any case, after a certain time period from the beginning of the washing process, the chemical action exerted by the detergent is partially wasted in attacking the amount of dirt which has already been removed from the articles being washed.

As has already been stated, in some known operative programs the washing phase is preceded by a prewashing phase carried out with heated washing solution in order to obtain a more effective result. Mainly, the prewashing phase has the function of mechanically removing coarse dirt particles from the articles being washed, thereby promoting the effectiveness of the subsequent actual washing phase. To this aim, the prewashing phase terminates with a drain step in which the washing solution is completely discharged, thereby discharging the dirt formerly removed; obviously, this reduces the above-mentioned problem of partially wasting the detergent used during the subsequent washing phase.

However, the subsequent washing phase is carried out as described above, by using a further volume of water to which a further amount of detergent is added and which has to be completely heated up. Therefore, the entire process has an undesirably long duration and generally involves a remarkable consumption of water and detergent, as well as a corresponding consumption of energy. Of course, this is in contrast with the current needs to save energy.

FR-A-2 128 575 teaches a washing process for clothes washing machines including a washing phase in which the washing solution is first heated up to a predetermined temperature and is eventually partially discharged. After the initial washing phase, an additional subsequent washing phase is performed by adding a further amount of fresh water and a further amount of detergent to the remaining washing solution, which is again heated up to the predetermined temperature. The additional washing phase replaces a traditional bleaching phase using corrosive bleaching agents, but undesirably prolongs the entire washing process and requires a substantial amount of detergent and energy. At any rate, no bleaching phase is commonly carried out in a dishwashing machine.

SUMMARY OF THE INVENTION

It is the main object of the present invention to provide a washing process for an automatic dishwashing machine by means of which dirt is removed from the washed articles more effectively without the need for substantial amounts of water, detergent and energy.

Another object of the present invention is to provide a washing process of the aforementioned kind by means of which dirt is effectively removed from the washed articles without the use of a prewashing phase and in which the duration of the entire washing process is comparatively short.

BRIEF DESCRIPTION OF THE DRAWINGS

The characteristics and advantages of the invention will be more apparent from the following description, made only by way of non-limiting example, with reference to the accompanying drawings, in which.

DETAILED DESCRIPTION OF THE PREFERRED EMBODIMENT

Figure 1:
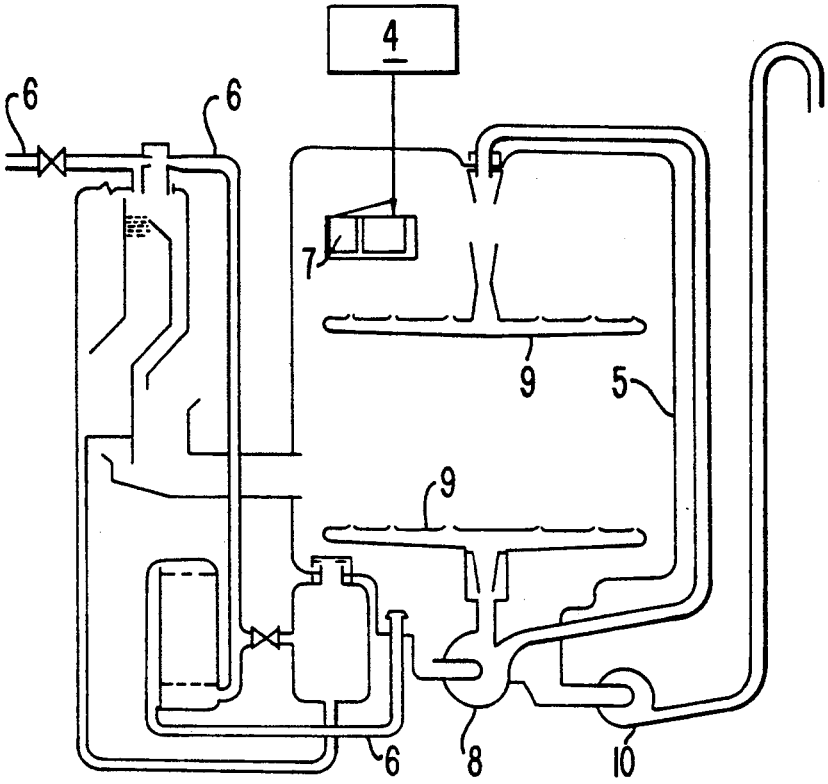
FIG. 1 is a schematic diagram of an automatic dishwashing machine capable of carrying out a washing process according to the invention.

With reference to FIG. 1, the dishwashing machine may be of a substantially common type and is not described in detail; for instance, it may be a dishwasher of the kind disclosed in EP-A-0 249 000 and is provided with a known detergent dispenser 7 having multiple compartments for selectively dispensing appropriate quantities of detergent into a wash tub 5. The dishwasher is further provided with a programmer 4 capable of controlling the main operative devices of the machine to automatically perform one or more processes which can be selected by a user.

The programmer 4 may be of an electromechanical type, or may be an electronic programmer comprising a Motorola 6804 or 6805 microprocessor, for example. In any case, it will be apparent to those skilled in the art that the programmer will set the different parameters (e.g., the times at which and the durations over which the various operative devices of the machine will operate) determining the time-controlled progress of the process according to the invention.

Figure 2:
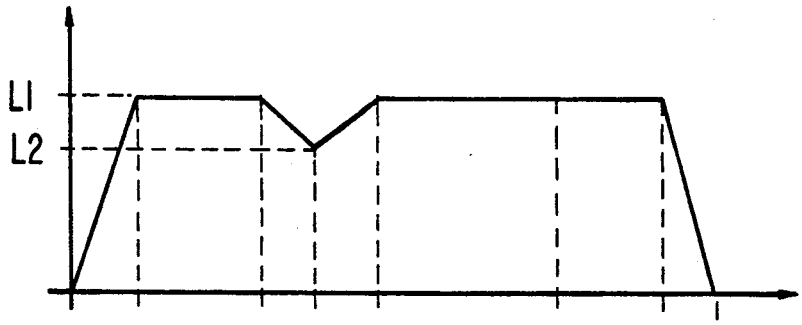
FIGS. 2 and 3 are curves representing the changes in level and temperature, respectively, of the water fed into a dishwashing machine during a preferred embodiment of the washing process according to the invention.
Figure 3:
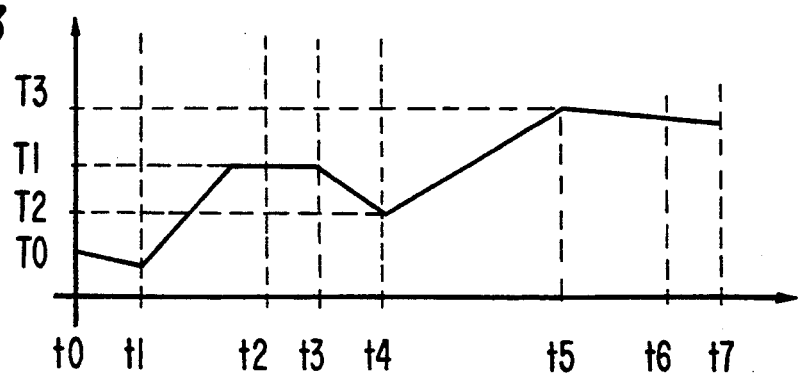

With reference to FIGS. 2 and 3, the washing process according to the invention is substantially started at a time to by feeding a certain volume (5–6 liters, for example) of tap water at a given temperature TO to the wash tub 5 via a supply circuit 6. During this step, a first predetermined metered amount of detergent, which will be discussed later, is added to the water in a per se known way.

For instance, as described in EP-A-0 118 719, the wash tub is preferably filled with water by concurrently operating a circulating pump 8 capable of supplying at least a rotary spray arm 9 with water to spray the articles to be washed (not shown).

The wash tub 5 is filled with water until a time t1, at which time the water reaches a predetermined level L1 (see FIG. 2). Substantially at this time the washing solution so formed in the wash tub 5 begins to be heated up, by, for example, a thermostatically controlled heating element, known per se and not shown. The washing solution is heated until it reaches a first predetermined temperature T1, while the circulating pump 8 keeps operating, preferably in a continuous way.

The programmer 4 controls a drain pump 10 to operate during a time period t2–t3. The drain pump 10 discharges the solution collected at the bottom of the wash tub 5. The time period t2–t3 is of a predetermined duration (approximately 10 sec, for example), which is established based on the general dimensions of the machine so as to allow a substantially small quantity of the washing solution, say about 1 liter, to be discharged, with the level of the washing solution in the wash tub 5 accordingly decreasing to a value L2. Furthermore, the temperature T1 preferably is one (at least 50° C., for example) which will facilitate the dilution of the organic fatty substances forming part of the dirt on the articles to be washed.

As a result, at time t2 a substantial amount of dirt has already been released from the articles being washed and is at least partially deposited on the bottom of the wash tub 5 along with a percentage of detergent which in practice cannot be used. The discharge of the washing solution occurring during time period t2–t3, though negligible in amount, causes the above amount of released dirt and unusable detergent to be substantially removed from the wash tub 5. The washing process can then progress with the heating means and circulating pump 8 in operation to spray the articles with washing solution whose remaining percentage of detergent is used in practice to chemically attack only the dirt still to be removed from the articles being washed.

In order to keep the circulating pump 8 under the best priming conditions, the washing solution in the wash tub 5 is preferably replenished with fresh tap water after the aforementioned discharge to restore the water level in the tub, during a time period t3–t4. According to an aspect of the invention, such replenishment involves a substantially negligible amount of fresh water corresponding to the amount of washing solution discharged during time period t2–t3, say, not more than 1/5 of the water volume initially fed into the wash tub. Hence, the temperature of the washing solution in the wash tub 5 decreases accordingly in a negligible way, down to a value T2. Therefore, the replacement of an amount of heated washing solution with an equal amount of fresh water during time period t3–t4 advantageously does not involve a substantial loss of thermal energy.

It is preferable, moreover, that at least a complementary metered amount of detergent be added to the washing solution after the time period t2–t3 during which the discharge of a portion of the washing solution occurs (e.g., during the water level restoration) in order to compensate for the percentage of detergent formerly discharged; as already stated, the complementary amount of detergent advantageously exerts its chemical action only on the remainder of the dirt.

According to another aspect of the invention, the first metered amount and the complementary amount of detergent are such that their total quantity is substantially equal to the average amount of detergent which would commonly be added into the wash tub of the machine to carry out a typical washing process. Preferably, the first and the complementary amounts of detergent are substantially equal, each corresponding to half of the typical average amount. When a powder detergent is used, for instance, an average amount of 3 g of detergent per liter of water is typically used during the washing process. By contrast, the washing process according to the invention comprises the addition of first and complementary amounts of detergent, each equal to 1.5 g per liter of water.

In a per se known manner, the washing process is continued after time t4 with operation of the circulating pump 8; in addition, the heating means is actuated until a time t5 at which the washing solution reaches a predetermined temperature T3, which is higher than temperature T1 and has for instance a value of approximately 65° C. The washing process is then terminated during a time period t5–t6 in which only the circulating pump 8 is operated, and a time period t6–t7 in which the washing solution is substantially completely discharged from the wash tub 5.

Attention is directed to the fact that the washing solution at the relatively higher temperature T3 promotes the remotion of starchy substances from the articles being washed. As is known, starchy substances are particularly difficult to remove, but according to the invention they are effectively attacked by substantially all of the detergent contained in the washing solution after step t2–t3. To summarize, the washing process according to the present invention advantageously involves a differentiated remotion of dirt from the articles to be washed: fatty and staining substances are mainly removed by the solution at temperature T1 during time period t1–t3, and starchy substances are removed by the solution at temperature T3 during time period t5–t6.

From experiments it was confirmed that the washing process according to the invention is substantially as effective in removing the dirt from the articles being washed, as is a traditional washing process including, besides a washing phase, a prewashing phase in which heated washing solution is used.

On the other hand, the washing process according to the invention has a comparatively small duration, substantially equal to that of a conventional single-phase washing process, and therefore requires amounts of water, detergent and energy which are substantially equal with respect to the conventional washing process.

In addition, the discharge of dirt from the wash tub 5 through the partial discharge of washing solution occurring during time period t2–t3 reduces the total amount of dirt which could at least partially clog the recirculation filter (not shown) usually provided in a dishwasher. This results in a higher hydraulic pressure of the jets of washing solution issuing from the spray arms 9, thereby further improving the effectiveness of the washing process.

The washing process according to the invention further provides an important advantage compared with a traditional washing process. In fact, the dilution of the washing solution occurring during time period t2–t4 reduces the final alkalinity of the washed articles, thereby making such articles more healthy to use. It was experimentally verified that, using the aforementioned exemplary parameters, the final alkalinity of the crockery subjected to the washing process according to the invention was reduced by about 10% compared to that when the conventional washing process was carried out.

Obviously, the washing process described above may undergo many modifications without departing from the scope of the invention. For example, the durations of the time periods and amounts may be different, as specific needs dictate.

What is claimed is:

1. In an automatic dishwashing machine having a wash tub, a method for washing articles disposed in the tub during a wash phase of a cycle of the machine, said method comprising:

feeding a predetermined volume of water into the wash tub;

dispensing a metered amount of detergent into the wash tub so that a washing solution is formed by the water and the detergent;

causing the washing solution to become heated to a first predetermined temperature of at least 50° C.;

subjecting the articles in the wash tub to the heated washing solution;

discharging a portion of the washing solution from the bottom of the tub after the washing solution has attained said first predetermined temperature to remove dirt from the tub which has been released from the articles and has accumulated at the bottom of the tub, said portion of the washing solution having a volume of at most 1/5 of said predetermined volume of water fed into the tub;

subsequently heating the washing solution in the tub to a second predetermined temperature greater than said first predetermined temperature; spraying the articles in the wash tub with the washing solution after the washing solution has been heated to said second predetermined temperature;

subsequently discharging substantially all of the washing solution from the wash tub.

2. A method as claimed in claim 1, wherein the dispensing of the detergent into the wash tub is carried out in first and second stages, the first stage of the dispensing of the detergent occurring before said portion of washing solution is discharged from the tub, and the second stage of the dispensing of the detergent occurring after said portion of washing solution is discharged from the tub.

3. A method ad claimed in claim 2, wherein equal amounts of detergent are dispensed into the wash tub in each of said first and second stages.

4. A method as claimed in claim 1, and further comprising replenishing the washing solution with fresh water having a volume equal to the volume of the portion of the washing solution discharged from the tub after said portion of the washing solution has been discharged from the tub.

5. A method as claimed in claim 1, and further comprising spraying the articles in the washing tub with the washing solution while the washing solution is being heated to said second predetermined temperature.

* * * * *